US007788962B2

(12) United States Patent
Chiasson et al.

(10) Patent No.: US 7,788,962 B2
(45) Date of Patent: Sep. 7, 2010

(54) HYDRAULIC TOOL

(75) Inventors: Mark A. Chiasson, Merrimack, NH (US); Richard E. Robicheau, Amherst, NH (US); John D. Lefavour, Litchfield, NH (US); Thomas R. Faucher, Manchester, NH (US)

(73) Assignee: Burndy Technology LLC, Manchester, NH (US)

( * ) Notice: Subject to any disclaimer, the term of this patent is extended or adjusted under 35 U.S.C. 154(b) by 677 days.

(21) Appl. No.: 11/803,419

(22) Filed: May 14, 2007

(65) Prior Publication Data

US 2008/0282763 A1 Nov. 20, 2008

(51) Int. Cl.
*B21D 9/18* (2006.01)
*B21D 7/06* (2006.01)

(52) U.S. Cl. ..... 72/453.15; 72/407; 72/453.16; 72/453.03; 60/477; 29/751; 30/180

(58) Field of Classification Search ..... 72/407, 72/453.03, 453.15, 453.16; 60/477, 479; 29/751; 30/180
See application file for complete search history.

(56) References Cited

U.S. PATENT DOCUMENTS

| | | | | |
|---|---|---|---|---|
| 326,597 | A | 9/1885 | Sergeant | 91/317 |
| 712,843 | A | 11/1902 | Paul | 173/30 |
| 4,381,037 | A | 4/1983 | Cuneo | 173/170 |
| 4,830,253 | A | 5/1989 | Hunter | 227/8 |
| 4,924,571 | A | 5/1990 | Albertson | 30/121 |
| 4,924,924 | A | 5/1990 | Stewart | 142/49 |
| 4,947,672 | A | 8/1990 | Pecora et al. | 72/453.16 |
| 5,228,610 | A | 7/1993 | Spence | 224/267 |
| 5,445,479 | A | 8/1995 | Hillinger | 408/16 |
| 5,582,350 | A | 12/1996 | Kosmyna et al. | 239/345 |
| 5,588,495 | A | 12/1996 | Dear et al. | 173/170 |
| 5,718,142 | A | 2/1998 | Ferraro | 72/326 |
| 5,727,417 | A | 3/1998 | Moffatt et al. | 72/453.03 |
| 5,979,215 | A | 11/1999 | Lefavour et al. | 72/453.16 |
| 6,237,698 | B1 | 5/2001 | Carrier et al. | 173/2 |
| 6,598,266 | B1 | 7/2003 | Elliott | 16/430 |
| 6,745,611 | B2 | 6/2004 | Lefavour et al. | 72/453.16 |
| 6,957,560 | B2 * | 10/2005 | Lefavour et al. | 72/453.16 |
| 7,111,488 | B2 * | 9/2006 | Lefavour et al. | 72/453.16 |
| 7,165,439 | B2 * | 1/2007 | Lefavour et al. | 72/453.16 |
| 7,254,982 | B2 * | 8/2007 | Frenken | 72/453.15 |
| 7,412,868 | B2 * | 8/2008 | Frenken | 72/453.15 |
| 2003/0182749 | A1 | 10/2003 | Boyer et al. | 15/97.1 |

* cited by examiner

*Primary Examiner*—David B Jones
(74) *Attorney, Agent, or Firm*—Harrington & Smith

(57) ABSTRACT

A hand-held hydraulic tool including a hydraulic drive system comprising a pump; and a user control system for at least partially controlling operation of the hydraulic tool. The user control system includes a first user control at a first location having a first pump activation control switch and a first hydraulic drive system drain control switch, and a second user control at a second location having a second pump activation control switch and a second hydraulic drive system drain control switch. The hydraulic tool is adapted to be controlled by a user at either of the first or the second locations.

30 Claims, 3 Drawing Sheets

HYDRAULIC TOOL

BACKGROUND OF THE INVENTION

1. Field of the Invention

The invention relates to a hydraulic tool and, more particularly, to a hydraulic tool control and tool use ergonomics.

2. Brief Description of Prior Developments

Various different hand-held tools are known which use hydraulics, such as an electrical connector crimper or an electrical conductor cutter for example. U.S. Pat. No. 6,745,611, which is hereby incorporated by reference in its entirety, shows one example of a tool with a handle to be held by one hand of a user. U.S. Pat. No. 5,727,417, which is hereby incorporated by reference in its entirety, shows another example with a suitcase type of handle.

As tools are being produced with higher output force, they inevitably get heavier. The additional weight makes traditional housing designs, such as illustrated in U.S. Pat. No. 6,745,611 for example, to be somewhat uncomfortable to use for some users. Traditionally, these larger tools are designed to be used in a "suitcase" style, similar to that illustrated in U.S. Pat. No. 5,727,417, where the operator holds a handle on top of the tool; operating activation and drain triggers with that same hand. However, there is a desire to provide a hand-held hydraulic tool which can be used other than in a "suitcase" style of holding, but also still be held in a comfortable manner when a user finds the weight of the tool to be too heavy.

SUMMARY OF THE INVENTION

In accordance with one aspect of the invention, a hand-held hydraulic tool is provided including a hydraulic drive system comprising a pump; and a user control system for at least partially controlling operation of the hydraulic tool. The user control system includes a first user control at a first location having a first pump activation control switch and a first hydraulic drive system drain control switch, and a second user control at a second location having a second pump activation control switch and a second hydraulic drive system drain control switch. The hydraulic tool is adapted to be controlled by a user at either of the first or the second locations.

In accordance with another aspect of the invention, a hydraulic tool is provided comprising a hydraulic drive system comprising a hydraulic fluid conduit system, a pump and a drain member connected to the conduit system; a first drain switch and a second drain switch located at different locations on the hydraulic tool; and a solenoid connected to the drain member and the drain switches. The solenoid is adapted to move the drain member to an open position when the first or second drain switches are activated by a user.

In accordance with another aspect of the invention, a hydraulic tool is provided comprising a hydraulic drive system comprising a pump, a hydraulic fluid conduit system, and a drain member connected to the conduit system; a user control system for controlling movement of the pump and the drain member comprising a first user control at a first location on the tool and a second redundant user control at a second location on the tool; and a system for preventing control of the tool by the second user control while a user's hand is at the first location.

In accordance with another aspect of the invention, a hand-held hydraulic tool is provided comprising a frame; a hydraulic drive system connected to the frame, wherein the hydraulic drive system comprises a pump, a hydraulic fluid conduit system, and a drain member connected to the conduit system;

a first hand grip section on the frame which is sized and shaped to allow a user to grasp the tool during operation, wherein the first hand grip section comprises a first user control adapted to at least partially control the hydraulic drive system; and a second hand grip section on the frame which is sized and shaped to allow a user to grasp the tool during operation, wherein the second hand grip section comprises a second user control adapted to at least partially control the hydraulic drive system. The tool is adapted to allow a user to operationally grasp the tool with a single hand at either the first or the second hand grip sections to allow alternative multi-locational holding of the tool during operation.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
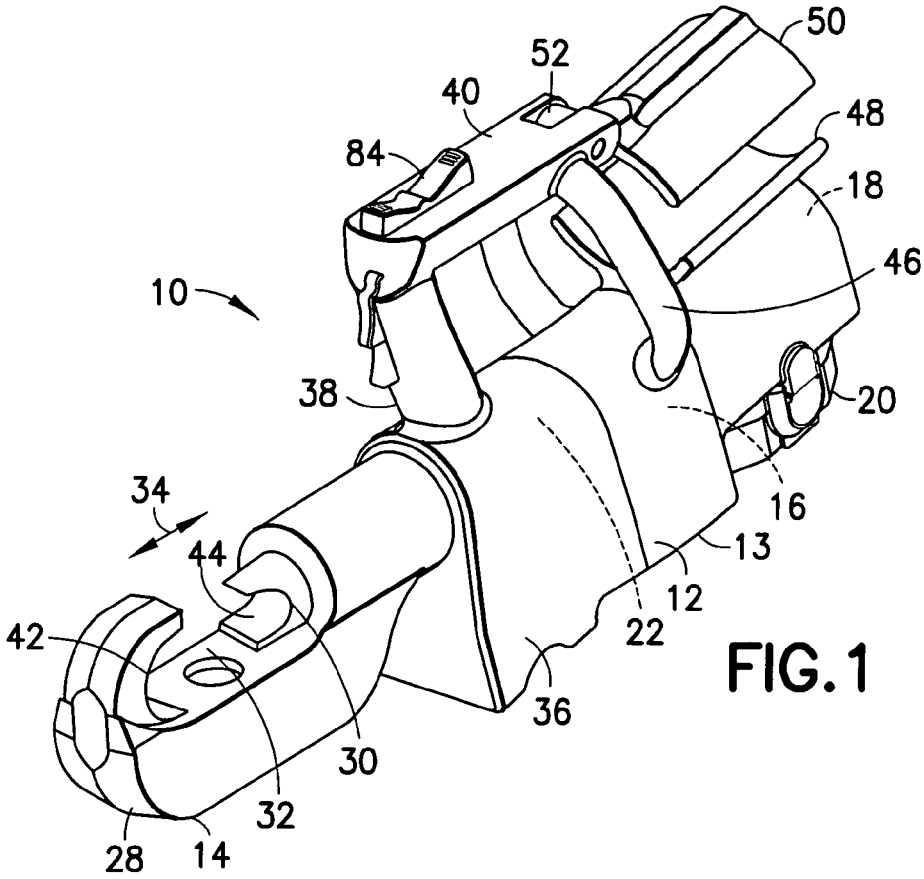
FIG. 1 is a perspective view of a tool comprising features of the invention.

Referring to FIG. 1, there is shown a perspective view of a hydraulic tool 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

Figure 2:
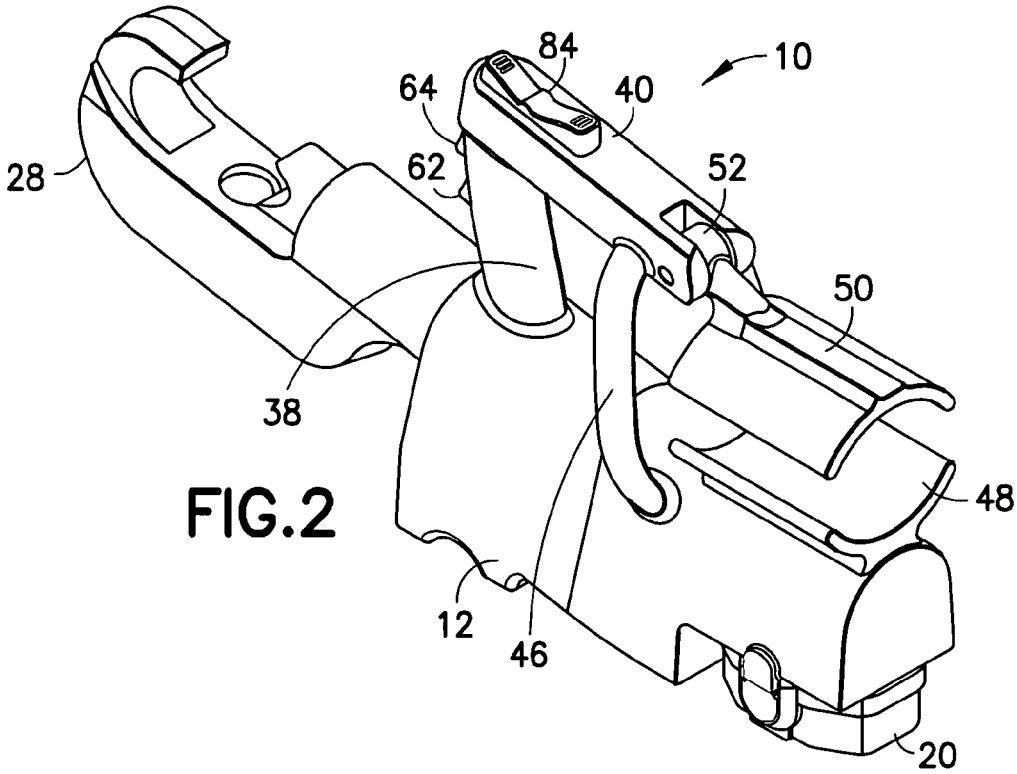
FIG. 2 is a perspective view of the tool shown in FIG. 1 from a different direction.
Figure 3:
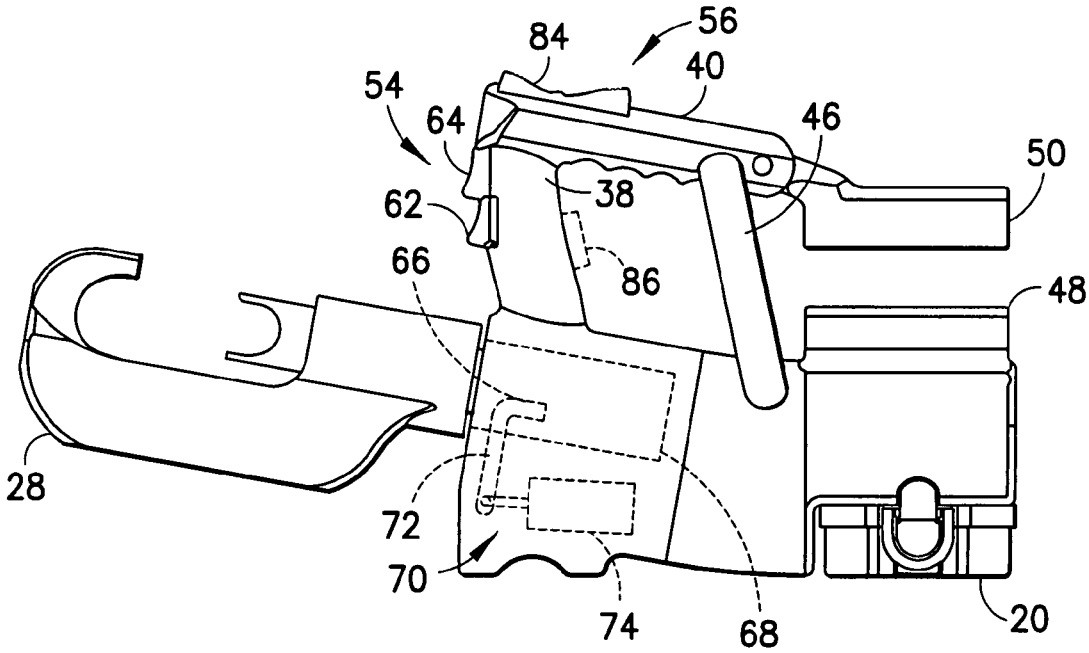
FIG. 3 is a side view of the tool shown in FIG. 1.
Figure 4:
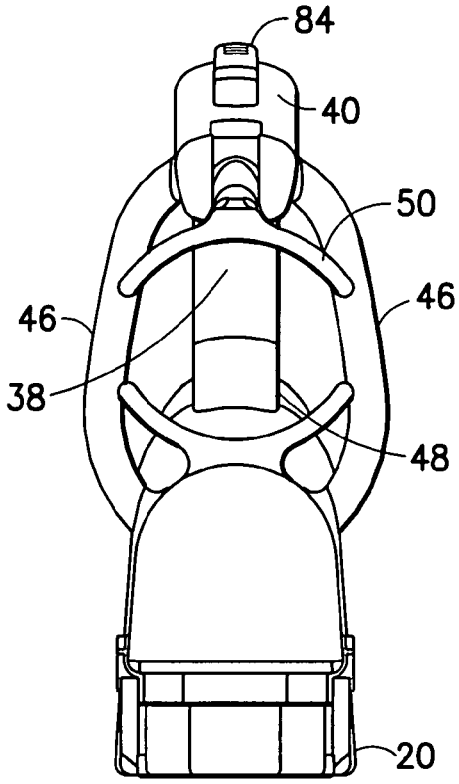
FIG. 4 is a rear end view of the tool shown in FIG. 1.

Referring also to FIGS. 2-4, the tool 10 is a crimping tool for crimping an electrical connector onto an electrical conductor. However, features of the invention could be used in any suitable type of tool including, for example, a hydraulic cutting tool or a non-hydraulic tool. The tool 10 generally comprises a frame 12 which can include an outer housing 13, a working head 14, a pump 16, a motor 18, a battery 20 and a fluid reservoir 22. In one type of embodiment the tool could comprise a controller 76 (see FIG. 5), such as a printed circuit board having a microprocessor and a memory. In alternate embodiments, the tool could comprise additional or alternative components.

The frame 12 forms a ram hydraulic drive conduit system. The working head 14 comprises a frame section 28 and a ram 30. The frame section 28 is stationarily connected to the front end of the frame 12, but could be rotatable. The ram 30 is movably connected to the section 28. In the exemplary embodiment shown, the section 28 and the ram 30 are adapted to removably receive conductor crimping dies (not shown) at a connector/conductor receiving area 32.

The crimping dies (not shown) are adapted to be removably mounted to the frame section 28 and the ram 30 at opposing locations 42, 44. The two locations 42, 44 form die mounting areas of the tool 10 for removably mounting the dies to the tool. However, features of the invention could be used in a die-less tool where the tool has permanent crimping surfaces for example. Features of the invention could also be used in a non-battery operated tool or a non-hydraulic tool.

The frame 12 forms a main section 36. The battery 20 is removably connected to the bottom rear of the main section 36. However, in alternate embodiments, the frame 12 could comprise different types of shapes. In addition, the battery 20 could be removably mounted to any suitable position on the frame. The battery 20 might also be fixedly mounted to the tool and not be removable. The battery 20 is preferably a rechargeable battery.

The motor 18 is connected to the battery 20, such as via the controller or a relay controlled by the controller. The motor 18 is adapted to operate at a nominal voltage corresponding to the voltage of the battery 20. The output shaft of the motor 18 is connected to the pump 16 by a gear reduction or gearbox. Any suitable type of gear reduction assembly could be provided.

The ram 30 is adapted to move forward and backward as indicated by arrow 34. The ram hydraulic drive conduit system is connected between the pump 16 and the rear end of the ram 30. Hydraulic fluid pumped by the pump 16 against the rear end of the ram 30 causes the ram 30 to move forward. The tool 10 preferably comprises a spring (not shown) which is adapted, as is known in the art, to return the ram 30 to its reward home position when hydraulic fluid pressure is released.

The ram 30 is located at the front of the main section 36. The pump 16, fluid reservoir 22, hydraulic fluid conduit system, and motor 18 are all located in the main section 36. In order to hold the tool 10 and operate the tool with a single hand of a user, the frame 12 has a first handle section 38 and a second handle section 40. The first handle section 38 extends upward from the top front of the main section 36. The second handle section 40 extends rearward from the top of the front handle section 38; generally parallel to the main section 36. In this embodiment, the tool 10 comprises opposite side supports 46 which connect a rear end of the second handle section 40 to the main section 36. Thus, the first handle section 38 and the side supports 46 stationarily attach the second handle section 40 to the main section 36.

The tool 10 is adapted to be held at the first handle section 38 in a general "glove" type of positioning on a user's arm and hand. This is further described below. The tool 10 is also adapted to be alternatively held in a general "suitcase" type of positioning by the user grasping the second handle section 40 from above. Thus, the handle sections 38, 40 allow a user to alternatively hold the tool during use with a single hand in two different types of manners of use.

In this exemplary embodiment, the second handle section 40 and the main section 36 comprise opposing forearm supports 48, 50. The forearm supports 48, 50 are provided to add extra support of the tool on a user's arm while the user is grasping the front handle section 38 in the "glove" type of holding configuration. More specifically, the user inserts his or her hand and forearm between the forearm supports 48, 50, and between the opposite side supports 46, to a location between the second handle 40 and the main section 36. The user can then grasp the first handle section 38 from behind. Thus, the user's hand is inserted into the tool similar to a glove.

The forearm supports 48, 50 have curved surfaces to generally conform to a user's forearm. The top forearm support 50 is movably connected to the rear end of the second handle section 40 by a pivot 52. The top forearm support 50 could be rotated upward, such as 90 degrees, to accommodate a user with a relatively short forearm. However, in alternate embodiments the top forearm support 50 might not be movable. Alternatively, the forearm supports might not be provided.

Figure 5:
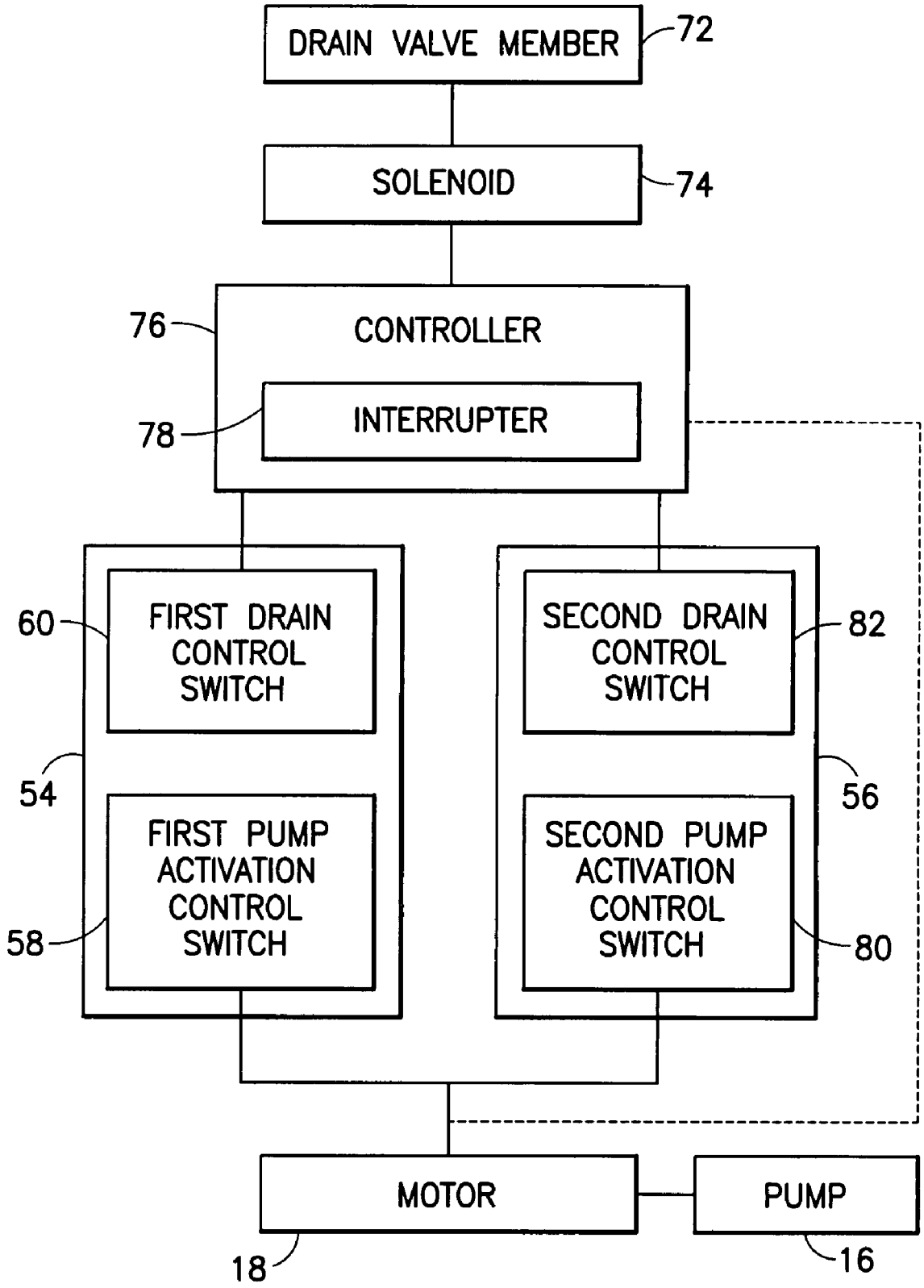
FIG. 5 is a diagram illustrating some of the components of the tool shown in FIG. 1.

The first handle section 38 forms a first hand grip section having a first user control 54. The second handle section 40 forms a second hand grip section having a second user control 56. Referring also to FIG. 5, the two user controls 54, 56 form part of a user control system for controlling the pump 16 and the ram retract feature of the tool. The retraction of the ram 30 is accomplished by the ram's return spring and the release of hydraulic fluid from behind the ram back to the hydraulic fluid reservoir 22. The release of the hydraulic fluid is accomplished by opening a drain valve or release valve which is connected in the hydraulic conduit system in the frame 12. This will be further described below.

The first user control 54 is located at the front of the first handle section 38. The first user control 54 comprises a first pump activation control switch 58 and a first hydraulic drive system drain control switch 60. The first user control 54 has a first depressible trigger 62 for actuating the first pump activation control switch 58. The first user control 54 also has a second depressible trigger 64 for actuating the first drain control switch 60. The first trigger 62 can be depressed by a user to actuate the motor 18, and thus actuate the pump 16. Thus, the switch 58 can be connected between the battery 20 and the motor 18, or merely to the controller (not shown) or relay.

The second trigger 64 can be depressed by a user to activate the first drain control switch 60. The first drain control switch 60 is adapted to send a signal which is used to open the release valve 66 (see FIG. 3). More specifically, the release valve 66 is movable located in a channel of the hydraulic conduit system 68 of the frame 12. For example, the release valve 66 could be a combined relief and release valve similar to that disclosed in U.S. Pat. No. 4,947,672 for example, which is hereby incorporated by reference in its entirety. The release valve 66 is normally biased in a closed position by a spring. The tool comprises a system 70 to move the release valve 66 to an open position. The system 70, in this exemplary embodiment, comprises a drain valve member 72 and a drive 74. In this embodiment the drive 74 comprises a solenoid. However, in alternate embodiments, any suitable type of drive could be provided, and any suitable connection of the drive to the release valve could be provided. For example, the drive could be an electrical motor. The drain valve member 72 is connected to the actuator arm of the solenoid 74 and is adapted to move the release valve 66 to an open position when the solenoid is actuated. The spring of the release valve can return the valve to a closed position when the solenoid is de-actuated.

In one type of embodiment, the first drain control switch 60 is directly connected to the solenoid 74 to actuate the solenoid when the trigger 64 is depressed by a user. However, in the embodiment shown, the first drain control switch 60 is indirectly connected to the solenoid 74 through the controller 76 and, more specifically, through an interrupter circuit 78 of the controller. The operation of the interrupter circuit 78 will be further described below.

The second user control 56 is located at the top front of the second handle section 40. The second user control 56 comprises a second pump activation control switch 80 and a second hydraulic drive system drain control switch 82. The second user control 56 has a rocker trigger or button 84 for alternatively actuating the second pump activation control switch 80 and the second drain control switch 82. The front section of the rocker trigger 84 can be depressed by a user to actuate switch 80 and, thus, actuate the motor 18 and pump 16. The rear section of the rocker trigger 84 can be depressed by a user to activate the second drain control switch 82. The second drain control switch 82 is adapted to send a signal which can be used to open the release valve 66 (see FIG. 3).

In one type of embodiment, the second drain control switch 82 is directly connected to the solenoid 74 to actuate the solenoid when the rear section of the trigger 84 is depressed by a user. However, in the embodiment shown, the second drain control switch 82 is indirectly connected to the solenoid 74 through the controller 76 and, more specifically, through the interrupter circuit 78 of the controller.

The interrupter circuit 78 is adapted to prevent or interrupt actuation of the solenoid 74 when the motor 18 is on (when the first or second pump activation control switches 58, 80 are actuated). In effect, when the motor 18 is on (when the first or second pump activation control switches 58, 80 are actuated), actuation of the first drain control switch 60 or the second drain control switch 82 will be prevented from opening the release valve 66. This prevents the release valve 66 from being opened during operation of the tool if the trigger 64 or the rear end of the trigger 84 is inadvertently depressed by the user or inadvertently depressed by the surrounding environment where the tool is being used.

In the embodiment described above, the interrupter circuit 78 can sense if the pump activation control switches 58, 80 are being actuated. In an alternate embodiment, the interrupter could comprise a sensor, such as a hand presence switch 86 to sense the presence of a user's hand at one of the hand grip locations and thereby interrupt use of the drain control switch at the other hand grip section. These are only examples. In an alternate embodiment, an interrupter might not be provided.

As noted above, as tools are being produced with higher output force, they inevitably get heavier. The additional weight makes traditional housing designs somewhat uncomfortable to use. Traditionally, these larger tools are designed to be used in a "suitcase" style where the operator holds a handle on top of the tool; operating activation and drain triggers with that same hand. The invention can provide a hand-held hydraulic tool which can be used both in a "suitcase" style of holding, and other than in a "suitcase" style of holding. This allows the tool to be held in at least two different fashions. This allows a user to select the manner of holding the tool which is most comfortable for that user. As the design of a more ergonomic housing progressed, it became apparent that a tool with activation-drain triggers in two locations could be advantageous. The method used to accomplish this can be through the use of electronic switches and a solenoid; driving a mechanical drain lever.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A hand-held hydraulic tool comprising:

a hydraulic drive system comprising a pump; and a user control system for at least partially controlling operation of the hydraulic tool, wherein the user control system comprises a first user control at a first location comprising a first pump activation control switch and a first hydraulic drive system drain control switch, and a second user control at a second location comprising a second pump activation control switch and a second hydraulic drive system drain control switch, wherein the hydraulic tool is adapted to be controlled by a user at either of the first or the second locations.

2. A hand-held hydraulic tool as in claim 1 wherein the tool comprises a frame with a first hand grip section and a second hand grip section, wherein the first location is at the first hand grip section and the second location is at the second hand grip section.

3. A hand-held hydraulic tool as in claim 1 wherein the first pump activation control switch and the first hydraulic drive system drain control switch comprise depressible triggers.

4. A hand-held hydraulic tool as in claim 1 wherein the second pump activation control switch and the second hydraulic drive system drain control switch comprise a depressible rocker button.

5. A hand-held hydraulic tool as in claim 1 wherein the hydraulic tool comprises a main section housing the hydraulic drive section, and a first handle section extending directly from the main section, and wherein the first user control is on the first handle section.

6. A hand-held hydraulic tool as in claim 5 wherein the hydraulic tool further comprises a second handle section extending at an angle from the first handle section, and wherein the second user control is on the second handle section.

7. A hand-held hydraulic tool as in claim 6 wherein the second handle section is located generally parallel to the main section.

8. A hand-held hydraulic tool as in claim 6 wherein the second handle section and the main section comprise opposing forearm support surfaces.

9. A hand-held hydraulic tool as in claim 8 wherein a first one of the forearm support surfaces is movably connected to the second handle section.

10. A hand-held hydraulic tool as in claim 6 wherein the second handle section has a front end connected to the first handle section, and wherein opposite side supports connect a rear end of the second handle section to the main section.

11. A hand-held hydraulic tool as in claim 1 wherein the hydraulic drive system comprises a hydraulic fluid conduit system and a drain member connected to the conduit system, and wherein the hydraulic tool further comprises a solenoid connected to the drain member and the drain switches, wherein the solenoid is adapted to move the drain member to an open position when the first or second drain switches are activated by a user.

12. A hand-held hydraulic tool as in claim 1 further comprising a system for preventing control of the tool by the second user control while a user's hand is at the first location.

13. A hand-held hydraulic tool as in claim 12 wherein the system for preventing control comprises a hand presence switch.

14. A hand-held hydraulic tool as in claim 12 wherein the system for preventing control comprises means for determining if at least a portion of the first user control is being actuated by a user.

15. A hydraulic tool comprising:

a hydraulic drive system comprising a hydraulic fluid conduit system, a pump and a drain member connected to the conduit system;

a first drain switch and a second drain switch located at different locations on the hydraulic tool; and a drive connected to the drain member and the drain switches, wherein the drive is adapted to move the drain member to an open position when the first or second drain switches are activated by a user.

16. A hydraulic tool as in claim 15 further comprising a first pump activation control switch and a second pump activation control switch at the different locations on the hydraulic tool.

17. A hydraulic tool as in claim 16 further comprising a system for preventing the drive from moving the drain member to the open position, when the first or second drain switches are activated by the user, when the first or second pump activation control switches are activated by the user.

18. A hydraulic tool as in claim 15 further comprising a system for preventing the drive from moving the drain member to the open position while the first pump activation control switch is activated by the user, when the second drain switch is activated by the user, wherein the system for preventing comprises a hand presence switch at a first one of the locations.

19. A hydraulic tool comprising:

a hydraulic drive system comprising a pump, a hydraulic fluid conduit system, and a drain member connected to the conduit system;

a user control system for controlling movement of the pump and the drain member comprising a first user control at a first location on the tool and a second redundant user control at a second location on the tool; and a system for preventing control of the tool by the second user control while a user's hand is at the first location.

20. A hydraulic tool as in claim 19 wherein the system for preventing control comprises a hand presence sensor at the first location.

21. A hydraulic tool as in claim 19 further comprising a drain member drive system connected to the drain member, wherein the drain member drive system is adapted to actuated by the first and second user controls, and wherein the system for preventing control comprises a system for preventing the second user control from actuating the drain member drive system while the first user control is actuated.

22. A hand-held hydraulic tool comprising:

a frame;

a hydraulic drive system connected to the frame, wherein the hydraulic drive system comprises a pump, a hydraulic fluid conduit system, and a drain member connected to the conduit system;

a first hand grip section on the frame which is sized and shaped to allow a user to grasp the tool during operation, wherein the first hand grip section comprises a first user control adapted to at least partially control the hydraulic drive system; and a second hand grip section on the frame which is sized and shaped to allow a user to grasp the tool during operation, wherein the second hand grip section comprises a second user control adapted to at least partially control the hydraulic drive system, wherein the tool is adapted to allow a user to operationally grasp the tool with a single hand at either the first or the second hand grip sections to allow alternative multi-locational holding of the tool during operation, and wherein the first user control comprises depressible triggers, and wherein the second user control comprises a depressible rocker button.

23. A hand-held hydraulic tool as in claim 22 wherein the hydraulic drive system further comprises a solenoid connected to the drain member and drain switches of the user controls, wherein the solenoid is adapted to move the drain member to an open position when the first or second drain switches are activated by a user.

24. A hand-held hydraulic tool comprising:

a frame;

a hydraulic drive system connected to the frame, wherein the hydraulic drive system comprises a pump, a hydraulic fluid conduit system, and a drain member connected to the conduit system;

a first hand grip section on the frame which is sized and shared to allow a user to grasp the tool during operation, wherein the first hand grip section comprises a first user control adapted to at least partially control the hydraulic drive system; and a second hand grip section on the frame which is sized and shaped to allow a user to grasp the tool during operation, wherein the second hand grip section comprises a second user control adapted to at least partially control the hydraulic drive system, wherein the tool is adapted to allow a user to operationally grasp the tool with a single hand at either the first or the second hand grip sections to allow alternative multi-locational holding of the tool during operation, and wherein the hydraulic tool comprises a main section housing the hydraulic drive section, wherein the first hand grip section extends directly from the main section, and wherein the second hand grip section extends directly from the first hand grip section at an angle from the first hand grip section.

25. A hand-held hydraulic tool as in claim 24 wherein the second hand grip section is located generally parallel to the main section.

26. A hand-held hydraulic tool as in claim 24 wherein the main section comprises a first forearm support surface and a second forearm support surface extends from a rear of the second hand grip section.

27. A hand-held hydraulic tool as in claim 26 wherein the second forearm support surface is movably connected to the second hand grip section.

28. A hand-held hydraulic tool as in claim 24 wherein the second hand grip section has a front end connected to the first hand grip section, and wherein opposite side supports connect a rear end of the second hand grip section to the main section.

29. A hand-held hydraulic tool comprising:

a hydraulic drive system comprising a pump; and a user control system for at least partially controlling operation of the hydraulic tool, wherein the user control system comprises a first pump activation control switch at a first hand grip location, and a second pump activation control switch at a separate second hand grip location, wherein the second hand grip location is spaced from the first hand grip location, wherein the first and second hand grip sections are sized, shaped and located relative to each other such that a user can hold the tool with a first hand at the first hand grip section and actuate the first pump activation control switch with the first hand without holding the tool at the second hand grip section, and the second pump activation control switch is adapted to be actuated by the user while the user is alternatively holding the tool at the second hand grip location with the first hand.

30. A hand-held hydraulic tool comprising:

a frame having a main section and a handle, wherein the handle extends generally upward from the main section, wherein the handle comprises a front section, a top section, and at least one rear side support, wherein a front of the top section is connected to the main section by the front section, wherein a rear of the top section is connected to the main section by the at least one rear side support, and wherein the at least one rear side support is located laterally off center from the top section;

a hydraulic drive system located in the main section of the frame, wherein the hydraulic drive system comprises a pump, a hydraulic fluid conduit system, and a drain member connected to the conduit system; and a user control adapted to at least partially control the hydraulic drive system, wherein the user control comprises a pump activation control switch on the handle which is adapted to actuate the pump.

* * * * *